US005743103A

United States Patent [19]

Taniguchi et al.

[11] Patent Number: 5,743,103

[45] Date of Patent: Apr. 28, 1998

[54] AIR CONDITIONER

[75] Inventors: Masami Taniguchi; Fumio Kondoh, both of Nagoya; Hironari Fujiki; Kenichi Miyazawa, both of Nishi-Kasugai-gun; Masahiko Takahashi, Nagoya, all of Japan

[73] Assignee: Mitsubishi Jokogyo Kabushiki Kaisha, Tokyo, Japan

[21] Appl. No.: 722,832

[22] Filed: Sep. 27, 1996

[30] Foreign Application Priority Data

Oct. 23, 1995 [JP] Japan ..... 7-274140

[51] Int. Cl.[6] ..... F24F 13/14

[52] U.S. Cl. ..... 62/186; 62/180; 236/38; 236/49.3

[58] Field of Search ..... 62/160, 180, 186, 62/408, 409, 411, 412; 236/38, 49.3; 454/256, 258; 165/300

[56] References Cited

U.S. PATENT DOCUMENTS 4,615,481 10/1986 Tanaami et al. ..... 236/38
4,966,009 10/1990 Ishii et al. ..... 62/160
5,072,878 12/1991 Aoki et al. ..... 236/38
5,251,814 10/1993 Warashina et al. ..... 236/49.3
5,385,031 1/1995 Kizawa et al. ..... 62/186

FOREIGN PATENT DOCUMENTS 2-287042 11/1990 Japan .

*Primary Examiner*—William Doerrler
*Attorney, Agent, or Firm*—Wenderoth, Lind & Ponack

[57] ABSTRACT

An air conditioner is provided and includes a louver which is provided at a blowing opening. The louver is moved rotationally from above to below or from below to above by a variable speed mechanism. At the time of heating, a louver rotational speed while the louver is moved rotationally in a range of a blowing angle $\theta_1$ is set to a speed $\omega_1$ within a vortices generation area relative to a wind velocity of blowing air flow. Also, a louver rotational speed while the louver is moved rotationally over the blowing angle $\theta_1$ is set to a speed $\omega_1$ within a vortices non-generation area relative to the wind velocity of blowing air flow. Thereby, at the time of heating, downward reach of warm air in a room while the louver is moved rotationally below the predetermined blowing angle and a temperature diffusibility while the louver is moved rotationally above the predetermined blowing angle are improved. Further, an air conditioner in which, at the time of cooling, a uniformity of temperature distribution is improved is also provided.

8 Claims, 12 Drawing Sheets

AIR CONDITIONER

BACKGROUND OF THE INVENTION

1. Field of the Invention

The present invention relates to an air conditioner which is able to provide a room temperature state in which a downward reach of blowing air in a room at the time of heating is good, a horizontal frontward reach of blowing air in a room at the time of cooling is good, a comfort temperature area is broad and a temperature uniformity is good.

2. Description of the Prior Art

In an indoor unit of air conditioner in the prior art, as shown in the Japanese patent application No. Hei 4(1992)-141402, there is disclosed such a construction that a louver is provided at a blowing opening and in case the louver is moved rotationally from above to below or from below to above by a variable speed mechanism, a rotational speed of the louver, while being moved rotationally from above to below, is set to a speed within a vortices non-generation area relative to a wind velocity of blowing air flow, or a rotational speed of the louver, while being moved rotationally from above to below, is set to a speed within a vortices non-generation area relative to a wind velocity of blowing air flow and a rotational speed of the louver, while being moved rotationally from below to above, is set to a speed within a vortices generation area relative to a wind velocity of blowing air flow.

Generally, there is a relationship between the rotational speed of the louver and the wind velocity of blowing air flow as follows.

In FIG. 14, in a case where the rotational speed of the louver 5 is larger than a predetermined rotational speed, the blowing air flow generates large vortices 6 backward relative to the rotational direction of the louver 5, and while this enhances a temperature diffusion in the louver rotational direction $\pm\theta$, a reachability of the flow to the blowing direction R is reduced and, especially at the time of heating, there is a tendency to cause a cold feeling around feet etc. due to insufficiency of the downward reachability.

On the other hand, in a case where the rotational speed of the louver 5 is smaller than the predetermined rotational speed, while the reachability of blowing air flow to the blowing direction R increases as compared with the above-mentioned case, the temperature diffusion in the louver rotational direction $\pm\theta$ becomes smaller and there is a tendency to cause a discomfort feeling due to insufficiency of temperature uniformity, a reduction of comfort temperature area, etc.

Further, in an indoor unit of an air conditioner in the prior art, in a case where the louver provided at the blowing opening is moved rotationally from above to below or from below to above by a variable speed mechanism, at the time of cooling, the louver is fixed or a control is made so that the louver is moved at a constant rotational speed and there is no louver control which would take into account vortices generation at the time of heating as mentioned above.

In the air conditioner in the prior art, there are following problems to be solved.

That is, at the time of heating, in the case where the louver is moved rotationally from above to below, while the louver is moved rotationally in approximately 40° to 50° inclined downwardly from the horizontal direction, the diffusion of heat is insufficient due to vortices not being and there is a problem that the uniformity of room temperature distribution is not good or it is warm only in a direction to which the blowing wind is directed.

Further, at the time of heating, in case the louver is moved rotationally from below to above, while the louver is moved rotationally in approximately 40° to 50° inclined upwardly from the vertical direction, vortices are generated, hence the reachability in the blowing direction is insufficient and there is a problem of a cold feeling around feet in the close vicinity of the floor surface.

On the other hand, at the time of cooling, in case the louver is fixed in the horizontal direction, vortices are not generated and the downward diffusion of heat in the room, which is mainly dependent on convection, is insufficient, hence there are problems with poor uniformity of room temperature distribution, the comfort temperature area is narrow and it becomes too cold only in the direction to which the blowing wind is directed.

Further, at the time of cooling, also in the case where the louver is moved rotationally at a constant rotational speed, there are problems in terms of comfort because that it becomes too cold only in the direction to which the blowing air flow is directed and a sufficiently uniform temperature is not formed throughout the entire room.

SUMMARY OF THE INVENTION

It is therefore an object of the present invention to provide an air conditioner which, at the time of heating, has an improved reachability in the downward direction in a room while a louver is moved rotationally below a predetermined blowing angle and an improved diffusibility of temperature while the louver is moved rotationally above the predetermined blowing angle.

It is also an object of the present invention to provide an air conditioner which, at the time of cooling, prevents it from becoming too cold only in the direction to which a blowing wind is directed and has an improved uniformity of temperature distribution in a room.

In order to attain the above objects, in an air conditioner as so constructed that a louver is provided at a blowing opening and said louver is moved rotationally from above to below or from below to above by a variable speed mechanism, one feature of the present invention is to employ the following means; that is, at the time of heating, a rotational speed of the louver while it is moved rotationally below a predetermined angle is set to a speed within a vortices non-generation area relative to a wind velocity of the blowing air flow.

On the other hand, at the time of heating, the rotational speed of the louver while it is moved rotationally above the predetermined angle is set to a speed within a vortices generation area relative to the wind velocity of the blowing air flow.

As for the predetermined blowing angle, it can be set to an angle of 40° to 50° inclined downwardly from the horizontal direction.

FIG. 2 shows a vortices generation area A and a vortices non-generation area B in the case where a blowing velocity (wind velocity) of air flow v and a louver rotational speed $\omega$ are changed. Where the blowing velocity is $v_1$, if the louver rotational speed is $\omega_1$, large vortices are generated, and while the temperature diffusion in the louver rotational direction $\pm\theta$ increases, the reachability to the blowing direction R decreases.

On the other hand, if the louver rotational speed is $\omega_2$, large vortices are not generated, and while the temperature diffusion in the louver rotational direction $\pm\theta$ becomes smaller, the reachability to the blowing direction R becomes larger.

In the present invention, at the time of heating, in case the louver is moved rotationally below the predetermined blowing angle, the rotational speed is set to a speed within the vortices non-generation area (area B in FIG. 2) relative to the wind velocity of blowing air flow, hence the downward reachability in the room can be secured enough.

On the other hand, at the time of heating, in case the louver is moved rotationally above the predetermined blowing angle, the louver rotational speed is set to a speed within the vortices generation area (area A in FIG. 2) relative to the wind velocity of blowing air flow, hence large vortices are generated backward of the louver rotational direction and the temperature diffusion in the louver rotational direction $\pm\theta$ is enhanced.

As a result thereof, a temperature field of broad comfort temperature area and good temperature uniformity is formed. Thus, according to the present invention, an air conditioner which is able to form a room air state of higher comfortability, as compared with the prior art, in which, at the time of heating, both the downward reachability in the room and the uniformity of temperature stand together can be provided.

In order to solve the above-mentioned problems at the time of heating, another feature of the present invention is to employ following means; that is, the blowing velocity of air flow while the louver is moved rotationally below a predetermined blowing angle is set to a velocity within a vortices non-generation area relative to the louver rotational speed and the blowing velocity of air flow while the louver is moved rotationally above the predetermined blowing angle is set to a velocity within a vortices generation area relative to the louver rotational speed. In this case also, the predetermined blowing angle can be set to an angle of 40° to 50° inclined downwardly from the horizontal direction.

FIG. 7 shows a vortices generation area A and a vortices non-generation area B in the case where the blowing velocity (wind velocity) of air flow $v$ and the louver rotational speed $\omega$ are changed. Where the louver rotational speed is $\omega_1$, if the blowing velocity is $v_1$, large vortices are generated, and while the temperature diffusion in the louver rotational direction $\pm\theta$ increases, the reachability to the blowing direction R decreases. If the blowing velocity is $v_2$, large vortices are not generated, and while the temperature diffusion in the louver rotational direction $\pm\theta$ becomes smaller, the reachability to the blowing direction R becomes larger.

In the present invention, at the time of heating, in case the louver is moved rotationally below the predetermined blowing angle, the blowing velocity of air flow $v$ is set to a velocity within the vortices non-generation area (area B in FIG. 7) relative to the louver rotational speed $\omega$, hence the downward reachability in the room can be secured enough.

On the other hand, in case the louver is moved rotationally above the predetermined blowing angle, the blowing velocity of air flow $v$ is set to a velocity within the vortices generation area (area A in FIG. 7) relative to the louver rotational-speed $\omega$, hence large vortices are generated backward of the louver rotational direction and the temperature diffusion in the louver rotational direction $\pm\theta$ is enhanced, and as a result thereof, a temperature field of broad comfort temperature area and good temperature uniformity is formed. Thus, according to the present invention, an air conditioner which is able to form a room air state of higher comfortability, as compared with the prior art, in which, at the time of heating, both the downward reachability in the room and the uniformity of temperature stand together can be provided.

In order to solve the above-mentioned problems at the time of cooling, a further feature of the present invention is to employ the following means; that is, at the time of cooling, the rotational speed of louver while it is moved rotationally above a predetermined blowing angle is set to a speed within a vortices non-generation area relative to the wind velocity of blowing air flow or to a stationary state or to a state wherein said both cases of state are used by switching.

On the other hand, at the time of cooling, the rotational speed of louver while it is moved rotationally below the predetermined blowing angle is set to a speed within a vortices generation area relative to the wind velocity of blowing air flow. The predetermined blowing angle can be set to an angle of 25° to 40° inclined downwardly from the horizontal direction.

As previously explained for FIG. 2 showing the vortices generation area A and the vortices non-generation area B in the case where the blowing velocity (wind velocity) of air flow $v$ and the louver rotational speed $\omega$ are changed, where the blowing velocity is $v_1$, if the louver rotational speed is $\omega_1$, large vortices are generated, and while the temperature diffusion in the louver rotational direction $\pm\theta$ increases, the reachability to the blowing direction R decreases.

On the other hand, if the louver rotational speed is $\omega_2$, large vortices are not generated, and while the temperature diffusion in the louver rotational direction $\pm\theta$ becomes smaller, the reachability to the blowing direction R becomes larger.

In the present invention, at the time of cooling, in the case where the louver is moved rotationally above the predetermined blowing angle, the louver rotational speed is set to a speed within the vortices non-generation area (area B in FIG. 2) relative to the wind velocity of blowing air flow, hence the reachability in the blowing direction R can be secured enough.

On the other hand, at the time of cooling, in case the louver is moved rotationally below the predetermined blowing angle, the louver rotational speed is set to a speed within the vortices generation area (area A in FIG. 2) relative to the wind velocity of blowing air flow, hence large vortices are generated backward of the louver rotational direction and the temperature diffusion in the louver rotational direction $\pm\theta$ is enhanced.

As a result thereof, a temperature field of broad comfort temperature area and good temperature uniformity is formed. Thus, according to the present invention, an air conditioner which is able to form a room air state of higher comfortability, as compared with the prior art, in which, at the time of cooling, both the horizontal frontward reachability in the room and the uniformity of temperature can be provided.

In order to solve the above-mentioned problems at the time of cooling, still another feature of the present invention is to employ the following means; that is, at the time of cooling, the blowing velocity of air flow while the louver is moved rotationally above a predetermined blowing angle is set to a velocity within a vortices non-generation area relative to the louver rotational speed and the blowing velocity of air flow while the louver is moved rotationally below the predetermined blowing angle is set to a velocity within a vortices generation area relative to the louver rotational speed.

As previously explained for FIG. 7 showing the vortices generation area A and the vortices non-generation area B in the case where the blowing velocity (wind velocity) of air flow v and the louver rotational speed ω are changed where the louver rotational speed is $\omega_1$, if the blowing velocity is $v_1$, large vortices are generated, and while the temperature diffusion in the louver rotational direction ±θ increases, the reachability to the blowing direction R decreases. If the blowing velocity is $v_1$, large vortices are not generated, and while the temperature diffusion in the louver rotational direction ±θ becomes smaller, the reachability in the blowing direction R becomes larger.

In the present invention, at the time of cooling, in the case where the louver is moved rotationally above the predetermined blowing angle, the blowing velocity of air flow v is set to a velocity within the vortices non-generation area (area B in FIG. 7) relative to the louver rotational speed ω, hence the reachability to the horizontal frontward direction in the room can be sufficiently secured.

On the other hand, at the time of cooling, in case the louver is moved rotationally below the predetermined blowing angle, the blowing velocity of air flow v is set to a velocity within the vortices generation area (area A in FIG. 7) relative to the louver rotational speed ω, hence large vortices are generated backward of the louver rotational direction and the temperature diffusion in the louver rotational direction ±θ is enhanced, and as a result thereof, a temperature field of broad comfort temperature area and good temperature uniformity is formed. Thus, according to the present invention, an air conditioner which is able to form a room air state of higher comfortability, as compared with the prior art, in which, at the time of cooling, both the horizontal frontward reachability in the room and the uniformity of temperature can be provided.

BRIEF DESCRIPTION OF THE DRAWINGS

In the accompanying drawings

DESCRIPTION OF THE PREFERRED EMBODIMENTS

Figure 14:
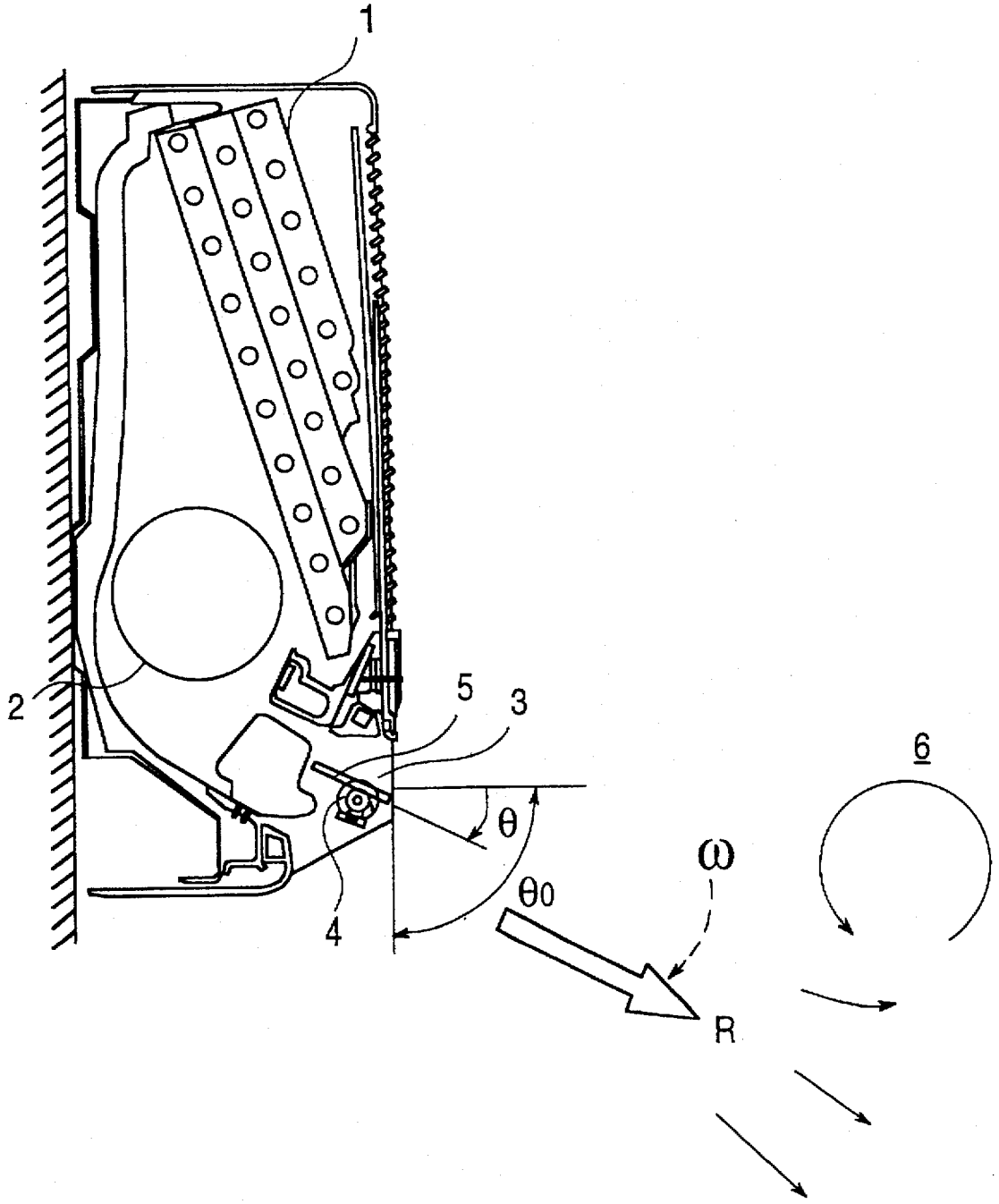
FIG. 14 (PRIOR ART)
FIG. 14 is a sectional view showing an indoor unit of a prior art air conditioner.

A first preferred embodiment according to the present invention is described with reference to FIGS. 1 to 5. In this preferred embodiment, an indoor unit of an air conditioner of the construction shown in FIG. 14 comprises a stepping motor 4 for driving a louver 5 so as to effect the control shown in FIG. 1. Incidentally, each portion of FIG. 14 is same as that described in the item "Description of the Prior Art" and repeated description is omitted.

Figure 1A:
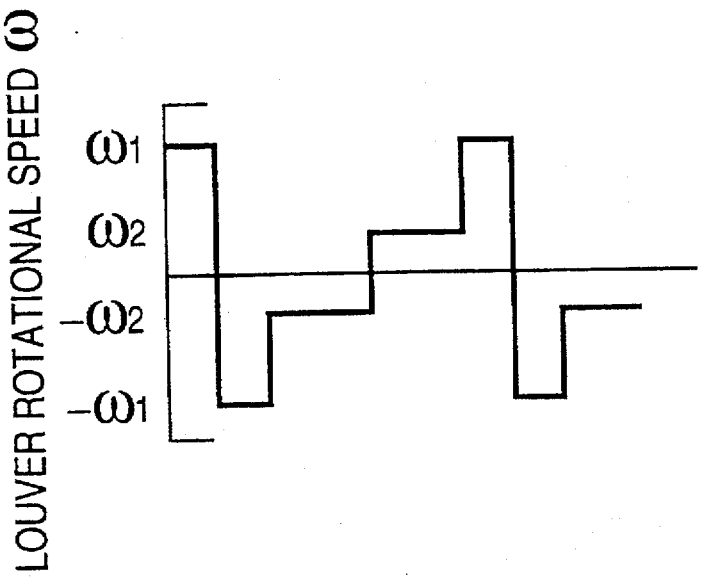
FIG. 1 is a graph showing a state of louver angle and louver rotational speed in a first preferred embodiment according to the present invention.
Figure 1B:
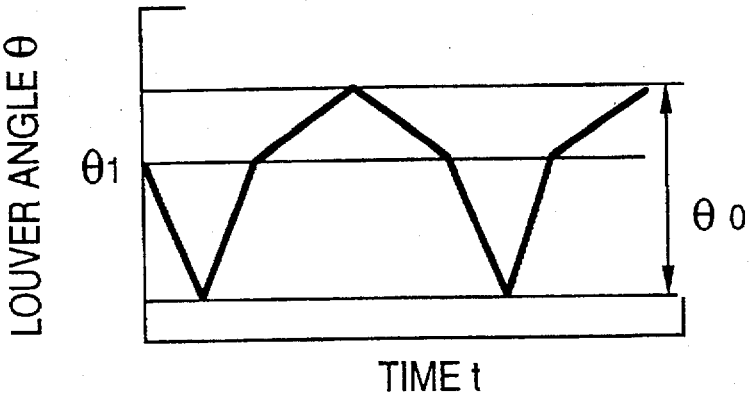

In this preferred embodiment, at the time of heating, in a case where the blowing velocity (wind velocity) of air flow from a blowing opening 3 is $v_1$, while the louver 5 is moved rotationally below a predetermined blowing angle, that is, while the louver angle θ in FIG. 1 is larger than $\theta_1$, the rotational speed ω of the louver 5 is set to a louver rotational speed $\pm\omega_2$ within the vortices non-generation area B in FIG. 2 and while the louver 5 is moved rotationally above the predetermined blowing angle, that is, while the louver angle θ in FIG. 1 is smaller than $\theta_1$, the rotational speed ω of the louver 5 is set to a louver rotational speed $\pm\omega_1$ within the vortices generation area A shown in FIG. 2.

Thereby, in this preferred embodiment, at the time of heating, when the angle of the louver 5 is larger than $\theta_1$, vortices of the blowing air flow, accompanying with rotation, are not generated and the reachability in the blowing direction R is secured, on the other hand, when the angle of the louver 5 is smaller than $\theta_1$, vortices of the blowing air flow, accompanying with rotation, are generated and the temperature diffusion in the louver rotational direction ±θ is accelerated.

Thus, at the time of heating, in a room space where air conditioning is taking place, a temperature distribution can be achieved in which the downward reachability of blowing air flow is good, the comfort temperature area is broad and the temperature uniformity in the entire room is good.

Figure 3A:
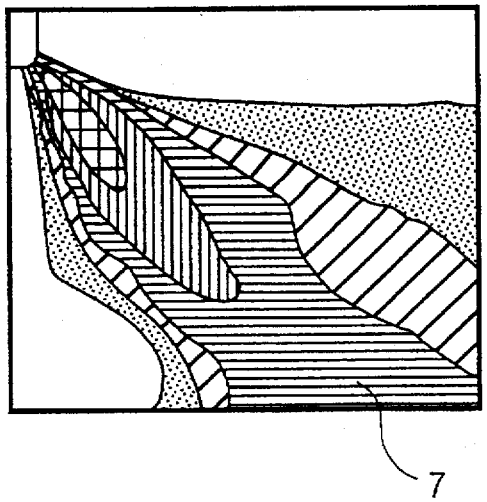
FIG. 3 is a view showing a room temperature distribution in the first preferred embodiment according to the present invention.
Figure 3B:
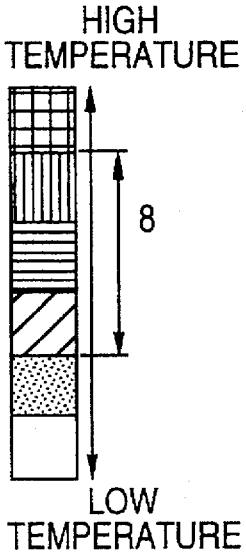
Figure 4:
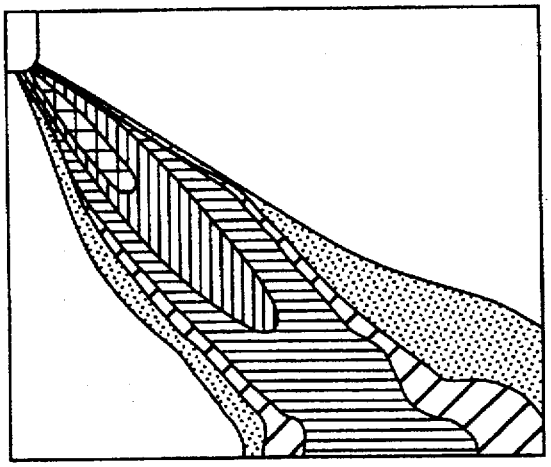
FIG. 4 (PRIOR ART)
FIG. 4 is a view showing a room temperature distribution in a prior art air conditioner.

FIG. 3 shows a room temperature distribution in the preferred embodiment according to the present invention and FIG. 4 shows a room temperature distribution in an air conditioner in the prior art. As mentioned above, in this preferred embodiment, the downward reachability 7 of blowing air flow in the room is good and the comfort temperature area 8 also is broad, as compared with the prior art.

Figure 5:
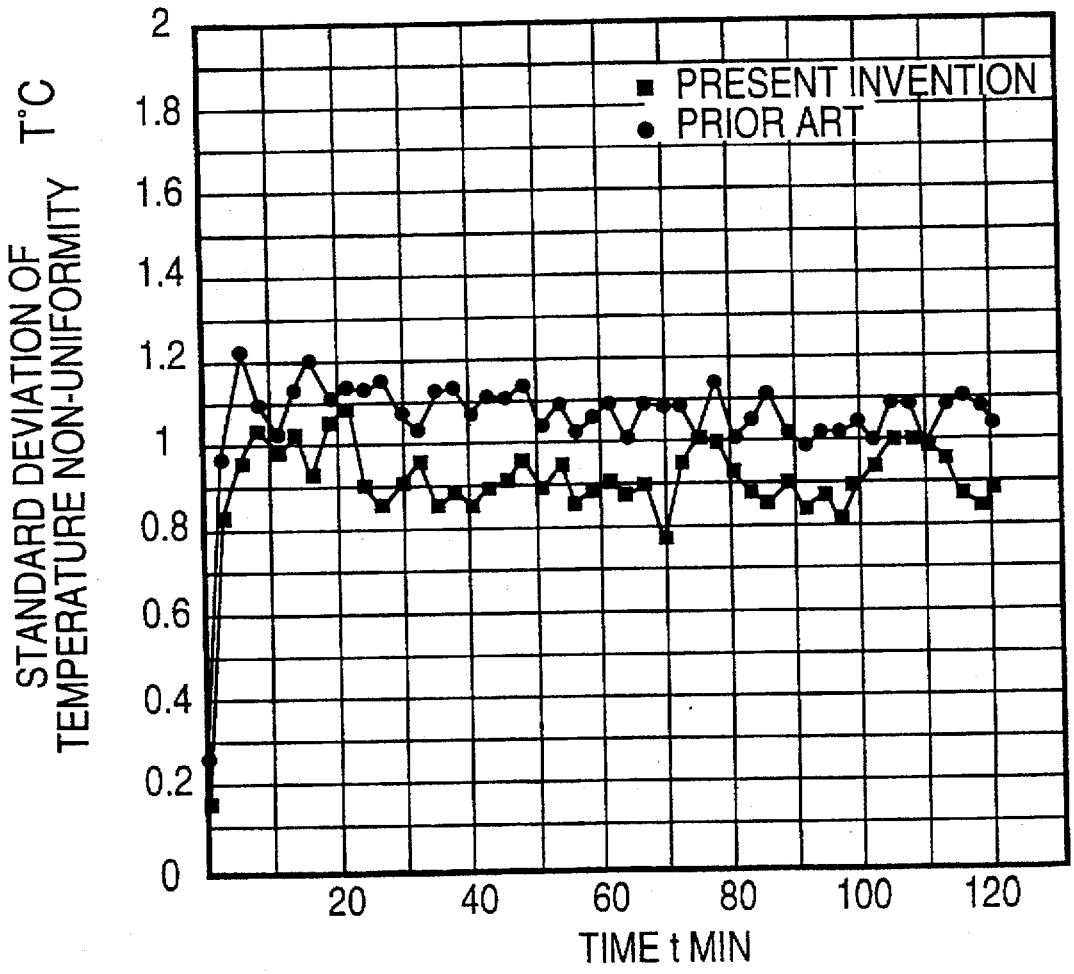
FIG. 5 is a diagrammatic view showing a time change from start-up of standard deviation of temperature non-uniformity at the position 60 cm above floor of the first preferred embodiment according to the present invention and of an air conditioner in the prior art.

FIG. 5 shows a standard deviation of temperature non-uniformity at the position 60 cm above a room floor of this preferred embodiment and of an air conditioner in the prior art. As mentioned above, in this preferred embodiment, a temperature distribution can be formed in which the standard deviation of temperature non-uniformity is small and the uniformity is good, as compared with the prior art.

Incidentally, in order to satisfy the reachability of blowing air flow and the uniformity of temperature distribution at the same time, it is most effective to set the louver angle $\theta_1$ for changing the louver rotational speed to an angle of 40° to 50°, but in a case where one of them is to be given a preference or according to an installation position etc., the angle $\theta_1$ may be made changeable for adjustment corresponding thereto.

(Second preferred embodiment)

Next, a second preferred embodiment according to the present invention is described with reference to FIGS. 6 to 8. In this preferred embodiment, an indoor unit of air conditioner of the construction shown in FIG. 8 comprises a variable speed motor 9 for driving a fan 2 so as to permit control of the blowing velocity of air flow as shown in FIG. 6 at the time of heating.

Figure 6A:
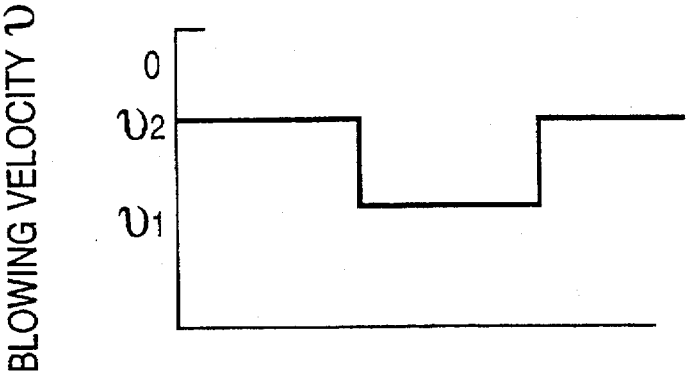
FIG. 6 is a graph showing a state of louver angle, louver rotational speed and blowing wind velocity in a second preferred embodiment according to the present invention.
Figure 6B:
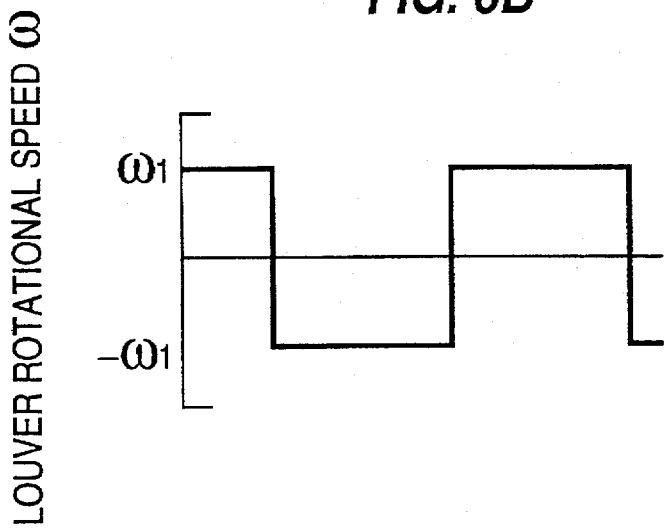
Figure 6C:
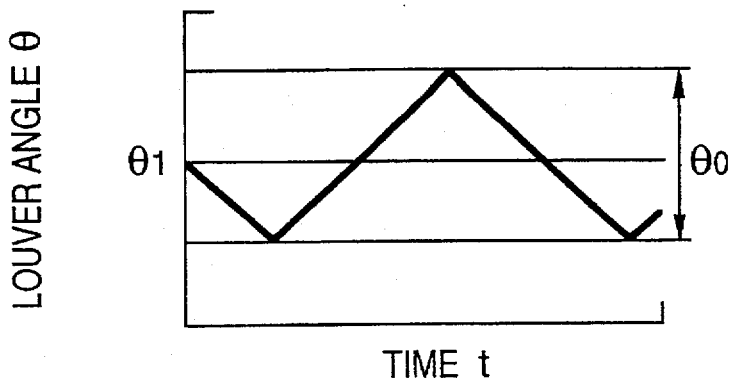
Figure 7:
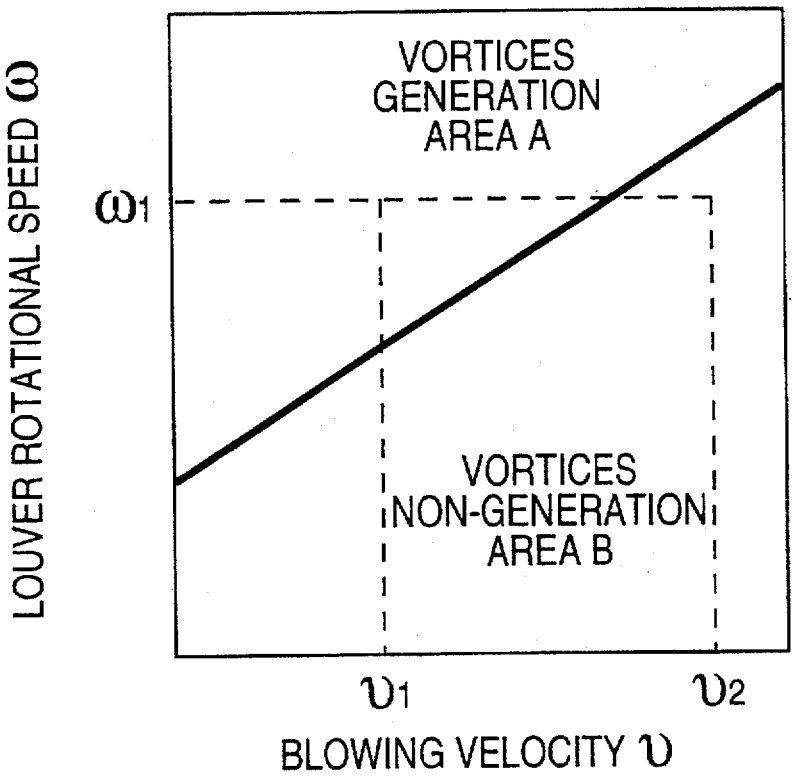
FIG. 7 is an explanatory view showing a vortices generation area and a vortices non-generation area of blowing air flow in an indoor unit of air conditioner.
Figure 8:
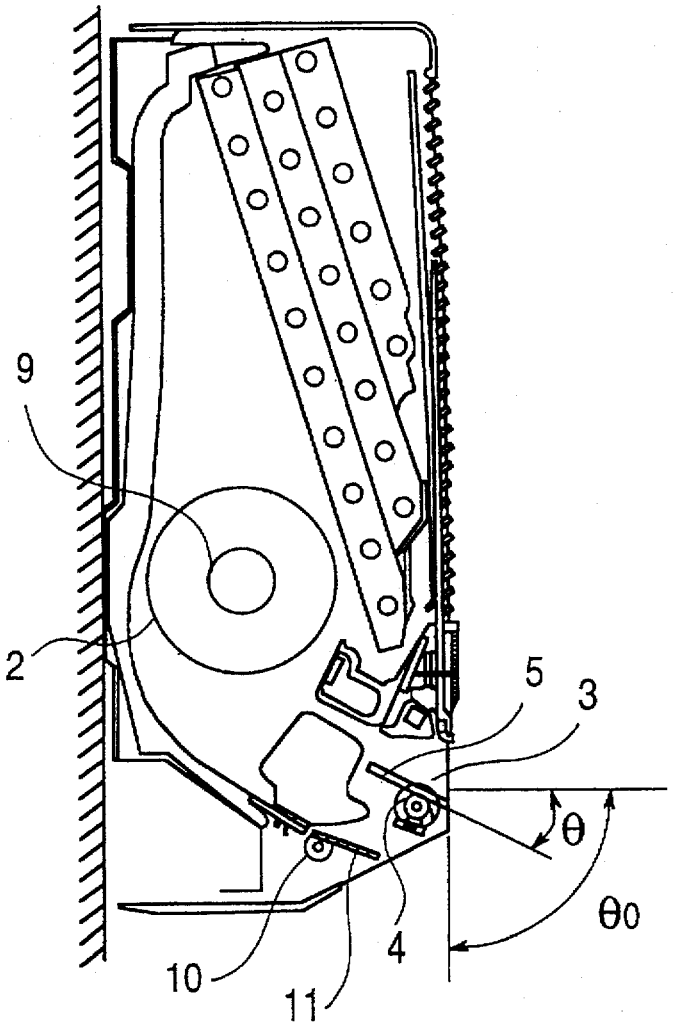
FIG. 8 is a sectional view showing a construction of an indoor unit of the second preferred embodiment according to the present invention in which the blowing velocity of air flow can be set.

In order to control the blowing velocity of air flows as shown in FIG. 6, a damper 11, to be driven by a stepping motor 10, for adjusting the height of blowing passage, as shown in FIG. 8, may be used. Incidentally, each portion of FIG. 8 is same as that described in the item "Description of the Prior Art" and repeated description is omitted.

In this preferred embodiment, at the time of heating, when the louver rotational speed is $\omega$, while the louver 5 is moved rotationally below the predetermined blowing angle, that is, while the louver angle $\theta$ in FIG. 6 is larger than $\theta_1$, the blowing velocity of air flow $v$ is set to a velocity $v_2$ within the vortices non-generation area B in FIG. 7 and while the louver 5 is moved rotationally above the predetermined blowing angle, that is, while the louver angle $\theta$ in FIG. 6 is smaller than $\theta_1$, the blowing velocity of air flow $v$ is set to a velocity $v_1$ within the vortices generation area A in FIG. 7.

Thereby, in this preferred embodiment, in case the angle of the louver 5 is larger than $\theta_1$, vortices of the blowing air flow, accompanying with rotation, are not generated and reachability in the blowing direction R is secured. On the other hand, in case the angle of the louver 5 is smaller than $\theta_1$, vortices of the blowing air flow, accompanying with rotation, are generated and the temperature diffusion in the louver rotational direction $\pm\theta$ is accelerated.

Thus, at the time of heating, in a room space where air conditioning is taken place, a temperature distribution can be formed in which the downward reachability of the blowing air flow is good, the comfort temperature area is broad and the temperature uniformity in the entire room is good.

(Third preferred embodiment)

A third preferred embodiment according to the present invention is described with reference to FIGS. 9 to 12. In this preferred embodiment, an indoor unit of air conditioner of the construction shown in FIG. 14 comprises a stepping motor 4 for driving a louver 5 so as to effect the shown in FIG. 9 at the time of cooling.

Figure 2:
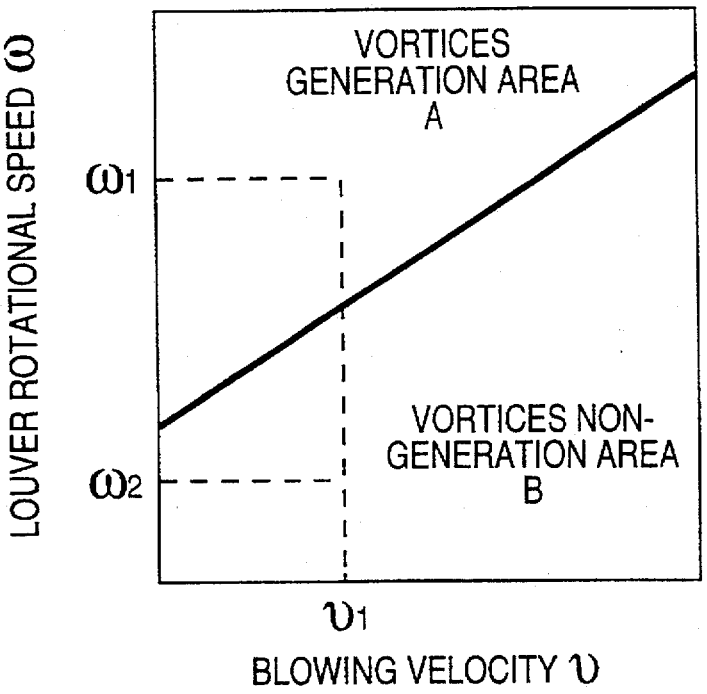
FIG. 2 is an explanatory view showing a vortices generation area and a vortices non-generation area of a blowing air flow in an indoor unit of an air conditioner.
Figure 9A:
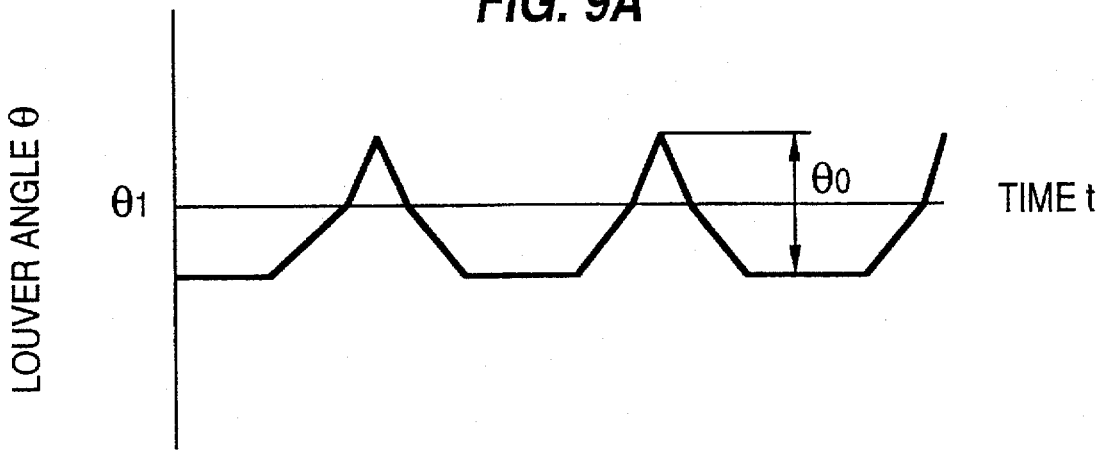
FIG. 9 is a graph showing a state of louver angle and louver rotational speed in a third preferred embodiment according to the present invention.
Figure 9B:
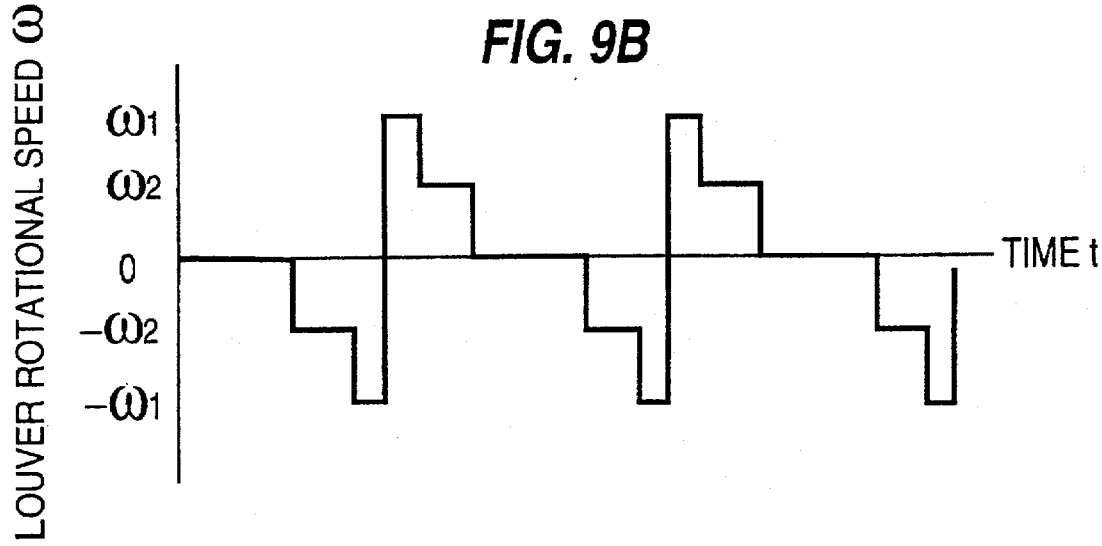

In this preferred embodiment, at the time of cooling, when the blowing velocity (wind velocity) of air flow from a blowing opening 3 is $v_1$, while the louver 5 is moved rotationally above a predetermined blowing angle, that is, while the louver angle $\theta$ in FIG. 9 is smaller than $\theta_1$, the rotational speed $\omega$ of the louver 5 is set to a louver rotational speed $\pm\omega_2$ within the vortices non-generation area B in FIG. 2 and to a stationary state during a certain time period, and while the louver 5 is moved rotationally below the predetermined blowing angle, that is, while the louver angle $\theta$ in FIG. 9 is larger than $\theta_1$, the rotational speed $\omega$ of the louver 5 is set to a louver rotational speed $\pm\omega_1$ within the vortices generation area A in FIG. 2.

Thereby, in this preferred embodiment, when the angle of the louver 5 is smaller than $\theta_1$, vortices of the blowing air flow, accompanying with rotation, are not generated and the reach of the blowing air in to the blowing direction R is secured. On the other hand, in case the angle of the louver 5 is larger than $\theta_1$, vortices of the blowing air flow, accompanying with rotation, are generated and the temperature diffusion in the louver rotational direction $\pm\theta$ is accelerated.

Thus, at the time of cooling, in a room space where air conditioning is taking place, a temperature distribution can be formed in which the horizontal frontward reachability of the blowing air flow is good, the comfort temperature area is broad and the temperature uniformity in the entire room is good.

Figure 10A:
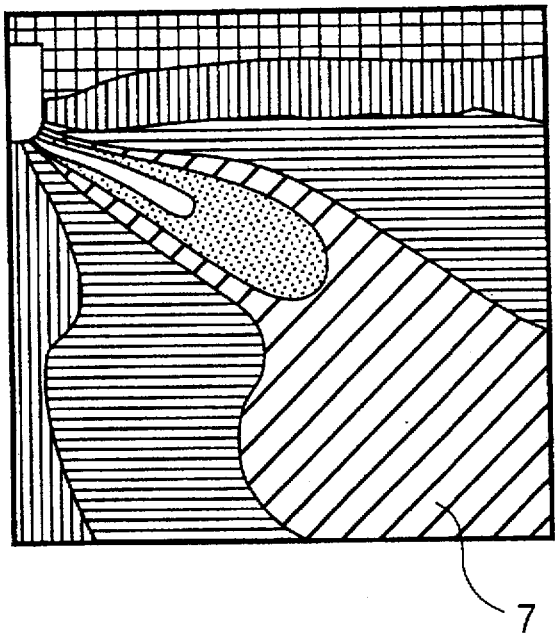
FIG. 10 is a view showing a room temperature distribution in the third preferred embodiment according to the present invention.
Figure 10B:
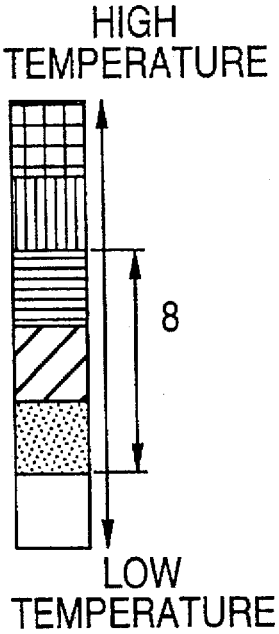
Figure 11:
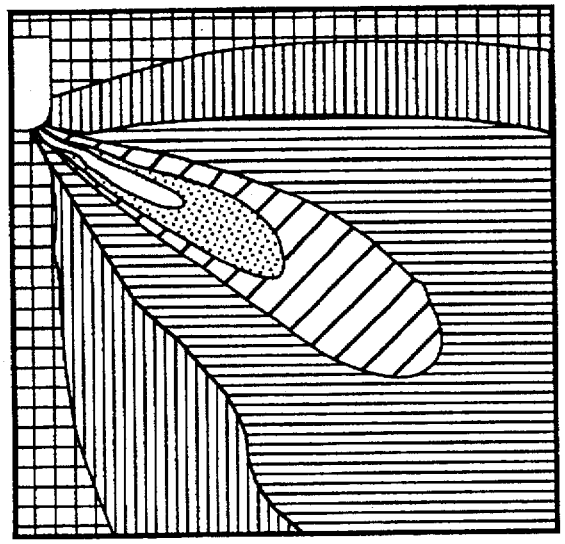
FIG. 11 (PRIOR ART)
FIG. 11 is a view showing a room temperature distribution in a prior art air conditioner.

FIG. 10 shows a room temperature distribution in this preferred embodiment according to the present invention and FIG. 11 shows a room temperature distribution in an air conditioner in the prior art. As mentioned above, in this preferred embodiment, at the time of cooling, the frontward reachability 7 of the blowing air flow in the room is good and the comfort temperature area 8 also is broad, as compared with the prior art.

Figure 12:
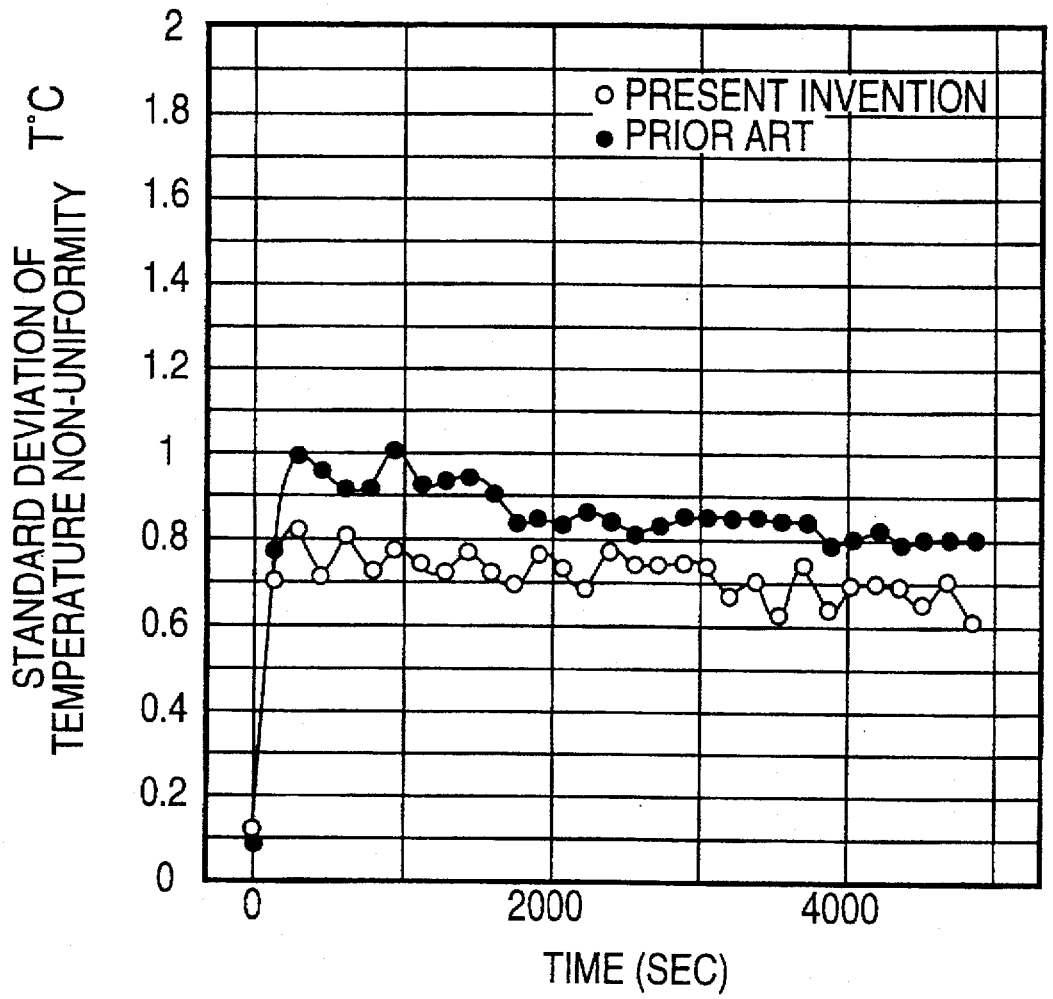
FIG. 12 is a diagrammatic view showing a time change from start-up of standard deviation of temperature non-uniformity at the position 60 cm above floor of the third preferred embodiment according to the present invention and of an air conditioner in the prior art.

FIG. 12 shows a standard deviation of temperature non-uniformity at the position 60 cm above the room floor of this preferred embodiment and of an air conditioner in the prior art. As mentioned above, in this preferred embodiment, a temperature distribution can be achieved in which the standard deviation of temperature non-uniformity is small and the uniformity is good, as compared with the prior art.

Incidentally, in order to satisfy the reachability of blowing air flow and the uniformity of temperature distribution at a same time, it is most effective to set the louver angle $\theta_1$ for changing the louver rotational speed to an angle of 25° to 40°, but in a case where one of them is to be given a preference or according to an installation position etc., the angle $\theta_1$ may be made changeable for adjustment corresponding thereto.

(Fourth preferred embodiment)

Next, a fourth preferred embodiment according to the present invention is described with reference to FIGS. 7, 8 and 13. In this preferred embodiment, an indoor unit of air conditioner of the construction shown in FIG. 14 comprises a variable speed motor 9 for driving a fan 2 so as to make control of the blowing velocity of air flow as shown in FIG. 13 at the time of cooling.

Figure 13A:
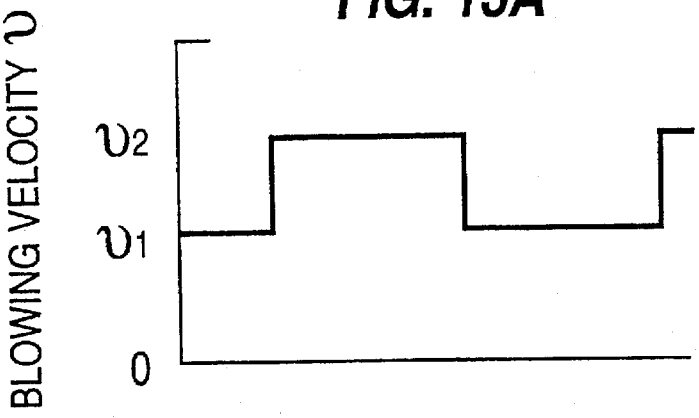
FIG. 13 is a graph showing a state of louver angle, louver rotational speed and blowing wind velocity in a fourth preferred embodiment according to the present invention.
Figure 13B:
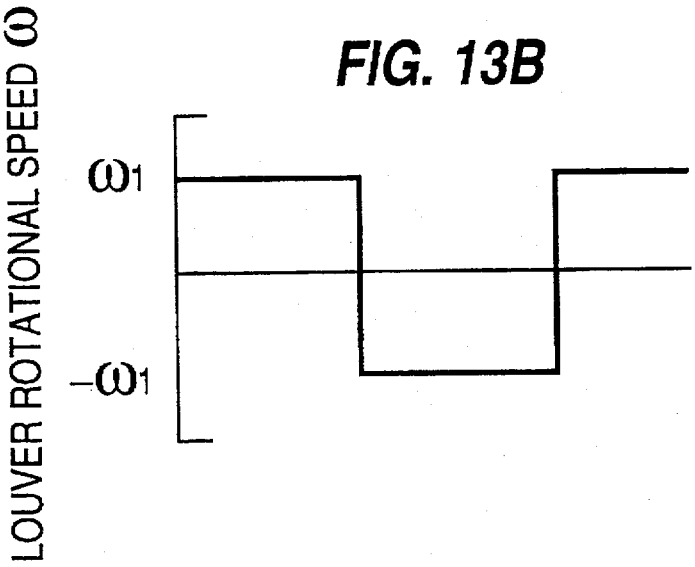
Figure 13C:
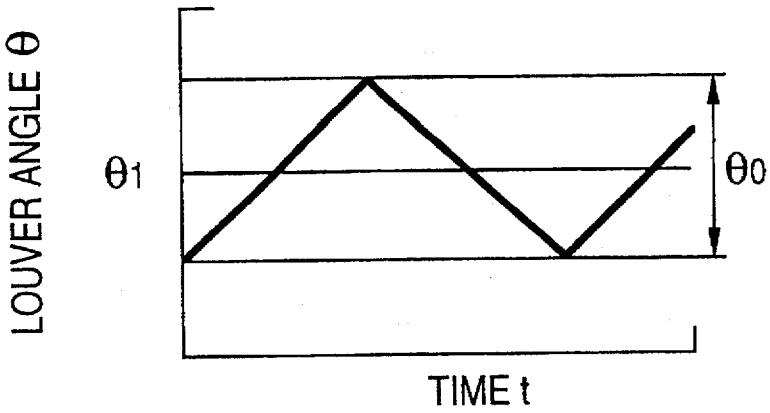

In order to make control of the blowing velocity of air flow as shown in FIG. 13, a damper 11, to be driven by a stepping motor 10, for adjusting the height of blowing passage, as shown in FIG. 8, may be used.

In this preferred embodiment, when the louver rotational speed is $\omega$, while the louver 5 is moved rotationally above the predetermined blowing angle, that is, while the louver angle $\theta$ in FIG. 13 is smaller than $\theta_1$, the blowing velocity of air flow $v$ is set to a velocity $v_2$ within the vortices non-generation area B shown in FIG. 7 and while the louver 5 is moved rotationally below the predetermined blowing angle, that is, while the louver angle $\theta$ in FIG. 13 is larger than $\theta_1$, the blowing velocity of air flow $v$ is set to a velocity $v_1$ within the vortices generation area A shown in FIG. 7.

Thereby, in this preferred embodiment, at the time of cooling, when the angle of the louver 5 is smaller than $\theta_1$, vortices of the blowing air flow, accompanying with rotation, are not generated and the reachability in the blowing direction R is secured, on the other hand, when the angle of the louver 5 is larger than $\theta_1$, vortices of the blowing air flow, accompanying with rotation, are generated and the temperature diffusion in the louver rotational direction $\pm\theta$ is accelerated.

Thus, at the time of cooling, in a room space where an air conditioning is taken place, a temperature distribution can be achieved in which the horizontal frontward reachability of blowing air flow is good, the comfort temperature area is broad and the temperature uniformity in the entire room is good.

An air conditioner according to the present invention, being constructed as mentioned above, has the following effect. At the time of heating, while the louver is moved rotationally below the predetermined blowing angle, the downward reach of the warm air in the room is good and especially the problem of a cold feeling around the feet is avoided.

And at the time of heating, while the louver is moved rotationally above the predetermined blowing angle, an air conditioning of high comfortableness can be provided in which the temperature diffusion is large, the comfort temperature area is broad and the temperature uniformity in the room space is good.

Further, at the time of cooling, while the louver is moved rotationally above the predetermined blowing angle, the horizontal frontward reach of the air in the room is good. And at the time of cooling, while the louver is moved rotationally below the predetermined blowing angle, an air conditioning of high comfortableness can be provided in which the temperature diffusion is large, the comfort temperature area is broad and the temperature uniformity in the room space is good.

While the preferred form of the present invention has been described, variations thereto will occur to those skilled in the art within the scope of the present inventive concepts which are delineated by the following claims.

What is claimed is:

1. An air conditioner in which a louver is provided at a blowing opening and said louver is moved rotationally from above to below or from below to above by a variable speed mechanism, wherein, at the time of heating, a rotational speed of said louver while said louver is moved rotationally below a predetermined blowing angle is set to a speed within a vortices non-generation area relative to a wind velocity of blowing air flow and a rotational speed of said louver while said louver is moved rotationally above the predetermined blowing angle is set to a speed within a vortices generation area relative to the wind velocity of blowing air flow.

2. An air conditioner in which a louver is provided at a blowing opening and said louver is moved rotationally from above to below or from below to above by a variable speed mechanism, wherein, at the time of heating, a blowing velocity of air flow while said louver is moved rotationally below a predetermined blowing angle is set to a velocity within a vortices non-generation area relative to a rotational speed of said louver and a blowing velocity of air flow while said louver is moved rotationally above the predetermined blowing angle is set to a velocity within a vortices generation area relative to the rotational speed of said louver.

3. An air conditioner as claimed in claim 1 wherein said predetermined blowing angle is set to an angle of 40° to 50° inclined downwardly from the horizontal direction.

4. An air conditioner in which a louver is provided at a blowing opening and said louver is rotationally movable from above to below or from below to above by a variable speed mechanism, wherein, at the time of cooling, a rotational speed of said louver while said louver is moved rotationally above a predetermined blowing angle is set to a speed within a vortices non-generation area relative to a wind velocity of blowing air flow or to a stationary state of said louver during a predetermined time period, and a rotational speed of said louver while said louver is moved rotationally below the predetermined blowing angle is set to a speed within a vortices generation area relative to the wind velocity of blowing air flow.

5. An air conditioner in which a louver is provided at a blowing opening and said louver is moved rotationally from above to below or from below to above by a variable speed mechanism, wherein, at the time of cooling, a blowing velocity of air flow while said louver is moved rotationally above a predetermined blowing angle is set to a velocity within a vortices non-generation area relative to a rotational speed of said louver and a blowing velocity of air flow while said louver is moved rotationally below the predetermined blowing angle is set to a velocity within a vortices generation area relative to the rotational speed of said louver.

6. An air conditioner as claimed in claim 4, wherein said predetermined blowing angle is set to an angle of 25° to 40° inclined downwardly from the horizontal direction.

7. An air conditioner as claimed in claim 2, wherein said predetermined blowing angle is set to an angle of 40° to 50° inclined downwardly from the horizontal direction.

8. An air conditioner as claimed in claim 5, wherein said predetermined blowing angle is set to an angle of 25° to 40° inclined downwardly from the horizontal direction.

* * * * *